US006041478A

United States Patent [19]

Martin

[11] Patent Number: 6,041,478

[45] Date of Patent: Mar. 28, 2000

[54] SAFETY HINGE APPARATUS AND METHOD FOR A SECTIONAL DOOR

[75] Inventor: David O. Martin, Salt Lake City, Utah

[73] Assignee: Martin Door Manufacturing, Inc., Salt Lake City, Utah

[21] Appl. No.: 08/971,497

[22] Filed: Nov. 17, 1997

[51] Int. Cl.[7] ..... E05D 5/10; E05D 5/00

[52] U.S. Cl. ..... 16/385; 16/380; 16/386; 160/229.1; 49/383

[58] Field of Search ..... 16/221, 380, 385, 16/386, 235, 373; 49/383; 160/201, 229.1

[56] References Cited

U.S. PATENT DOCUMENTS

| | | | |
|---|---|---|---|
| 2,315,488 | 4/1943 | Aldeen | 16/380 |
| 2,504,351 | 4/1950 | Ring | 16/342 |
| 3,894,654 | 7/1975 | Frankenberg | 16/385 |
| 4,771,508 | 9/1988 | Lautenschlager | 16/386 |
| 4,989,660 | 2/1991 | Wagner | 160/201 |

FOREIGN PATENT DOCUMENTS

| | | | |
|---|---|---|---|
| 631715 | 6/1936 | Germany | 16/386 |

OTHER PUBLICATIONS

Catalog "Hinges by Braun"; Catalog #155 (1975) by Braun Manufacturing Co., Inc.

*Primary Examiner*—Chuck Y. Mah
*Assistant Examiner*—Donald M. Gurley
*Attorney, Agent, or Firm*—J. Winslow Young

[57] ABSTRACT

A low-profile hinge for hingedly joining adjacent door sections of a sectional door. The low profile for the low-profile hinge is attained by using a relatively small diameter hinge pin fabricated from spring steel. The greater strength characteristic of spring steel compensates for the smaller diameter of the spring steel hinge pin to provide a hinge that has a lower profile while maintaining the necessary mechanical strength at a level equal to or greater than a conventional hinge. The spring steel hinge pin is fabricated to be incrementally shorter than the pin tube and the ends of the pin tube are crimped to retain the spring steel hinge pin in the pin tube.

4 Claims, 3 Drawing Sheets

SAFETY HINGE APPARATUS AND METHOD FOR A SECTIONAL DOOR

BACKGROUND

1. Field of the Invention

This invention relates to hinges for sectional doors and, more particularly, to a novel, low-profile hinge constructed around a smaller diameter hinge pin fabricated from a spring steel to thereby significantly reduce the gap between door sections to preclude the insertion of a fingertip into the gap.

2. The Prior Art

Sectional doors, as the name implies, are fabricated from discrete door sections that are hingedly joined along adjacent edges to create the sectional door. Sectional doors are specifically designed to provide a closure mechanism across a large opening, typically, an automobile garage, or the like. As such, a sectional door spans a relatively wide opening, usually several meters in width and, on occasion, several meters in height. The sectional door is fabricated from a plurality of door sections hingedly joined in an edge-to-edge relationship to enable the sectional door to travel up and down between its vertical orientation where it serves as the closure to the opening and the open position where it is supported in an overhead orientation where it is temporarily held until returned to the closed or vertical position. The ends of the door sections are supported and guided by rollers that are confined to tracks. The tracks are positioned adjacent the opening such that they support the sectional door in its closed position, its opened position, and during its traverse between these two positions. The tracks include a curved section across which the sectional door traverses between positions. Traversal of this curved section of track is the reason the sectional door is assembled from door sections hingedly joined together along adjoining edges. It is this feature of the sectional door that creates a particularly dangerous situation. Specifically, as the sectional door is lowered, and each door section traverses the curved section of track, each door section changes its planar orientation from the horizontal to a vertical position. The hinges between door sections accommodate this change in orientation so that the entire sectional door is able to effectively follow a curvilinear path in its movement to the closed position. Customarily, this entire procedure of closing a sectional door by lowering it from its elevated, horizontal, open position to its lowered, vertical, closed position requires less than about eight seconds. This means that as each door section traverses the curved section of track it relatively rapidly rotates through about a 90 degree orientation from the horizontal to the vertical positions. As each door section makes this transition in orientation, the hinges between door sections cause a gap to be created between door sections. This gap opens and closes relatively rapidly due to the overall closure rate of the sectional door.

Historically, the door sections were hingedly joined in their edge-to-edge relationship by door hinges specifically designed for use on sectional doors. These sectional door hinges were configured as dual purpose hinges in that those door hinges mounted along the outer edges of the sectional door could serve double duty not only as a hinge but also as the support socket for the shank of a roller bearing engaged in the adjacent support track. To accomplish this double duty the door hinge was fabricated around a tubular socket which served both as the pivot around which the hinge pivoted, and also as a socket to telescopically receive the shank of the roller bearing. As a natural consequence of using the tubular socket as the hinge pin, the door hinge was fabricated such that the tubular socket was supported several centimeters away from the surface of the sectional door. In turn, this rather large spatial distance between the pivot of the door hinge and the surface of the sectional door resulted in the prior art door hinge creating a relatively large gap between door sections as the sectional door moved downwardly across the curved section of track. This gap was generally within the range of at least two to three centimeters, a gap capable of receiving the fingers of most people.

The foregoing hinge configuration has resulted in the severe injury to the fingers of literally thousands of people. These injuries occur when the person operating the sectional door either inadvertently or deliberately places his/her fingers in the gap between door sections as the sectional door is being lowered to the closed position. Often, these injuries occur when the person grasps the sectional door to hasten its closure. Regrettably, the logical place to grasp a sectional door, particularly one that is insulated and thereby has a smooth inner surface, is at the edge of the door section, the edge having been exposed by the pivotal movement of the sectional door as discussed hereinbefore.

As a consequence of these injuries, the trend in the garage door or, rather, sectional door industry has been to change the old style sectional door hinge to a flatter, conventional leaf-type or strap hinge. This hinge, as the name implies, uses two, essentially flat, hinge leaves or hinge plates pivotally joined at their center around a hinge pin. This type of hinge is fabricated by at least two interdigitated fingers which are curled about a common hinge pin.

In recognition of the fact that the spatial separation of the centerline of the hinge pivot from the surface of the sectional door determines the extent to which the gap between door sections will open as the door sections pivot about the hinges, every possible step has been taken to reduce this spatial separation. However, it has been found that there is a minimal distance by which the pivot point can be brought simply due to the nature of the material of construction of the hinge itself. Simply stated, the forces imposed on the hinges dictate that the metal from which the hinge is constructed must be of sufficient thickness to withstand the forces involved. For example, I have found that a hinge capable of withstanding the normal forces imposed by movement of the sectional door must be fabricated from a galvanized steel having a gauge thickness of at least 14 gauge. Further, and even more importantly, the hinge pin must be fabricated with a diameter of at least 3/16 of an inch (0.476 cm) in order to withstand the forces imposed upon the hinge. For example, I have found that a strap hinge fabricated from a 14 gauge, galvanized steel and having a 3/16 inch (0.476 cm) diameter hinge pin can withstand a pull force of about 450 pounds (204 kilograms) before deformation of the hinge occurs. This deformation causes the hinge pin to bend and the enclosing pin tube to stretch and open. Even at 3/16 inch (0.476 cm) diameter, this hinge pin creates a gap of at least 5/8 inch (1.5875 cm) between door sections. This gap is clearly large enough to receive at least the tips of the fingers of most people.

In an attempt to reduce this gap to a maximum of only 1/4 inch (0.635 cm), I ordered the fabrication of a strap hinge with a hinge pin having a 1/8 inch (0.318 cm) diameter. Regrettably, this hinge failed at a pull force of only about 200 pounds (91 kilograms), a strength utterly inadequate for most sectional door applications.

In view of the foregoing, it would be an advancement in the art to provide a strap hinge fabricated around a smaller diameter hinge pin to provide for a reduced gap opening in a sectional door while at the same time maintaining the same or greater strength characteristics of a hinge pin of a larger diameter. It would be an even further advancement in the art to provide a hinge pin fabricated from a material of construction that has historically not been considered as a suitable material of construction for a hinge pin. It would be an even further advancement in the art to provide modifications in the manufacture of strap hinges in order to accommodate this new material of construction for hinge pins. Such a novel invention is disclosed and claimed herein.

BRIEF SUMMARY AND OBJECTS OF THE INVENTION

This invention involves the novel discovery that a hinge for a sectional door can be fabricated to operate with a smaller than expected opening by incorporating a smaller hinge pin that has been prepared from a spring steel. The spring steel hinge pin is incrementally shorter than the width of the hinge and the outer ends of the hinge tube are crimped to hold the spring steel hinge pin in place. Surprisingly, my novel hinge pin concept provides this hinge with a narrower opening while maintaining the same strength profile as a hinge with a conventional hinge pin.

It is, therefore, a primary object of this invention to provide improvements in hinges.

Another object of this invention is to provide improvements in the method of reducing the diameter of a hinge pin thereby reducing the opening between items hingedly joined by the hinge.

Another object of this invention is to provide a hinge pin prepared from a spring steel, the spring steel allowing the hinge pin to be fabricated with a reduced diameter.

Another object of this invention is to provide a hinge wherein the length of the hinge pin is incrementally shorter than the length of the hinge tube and the ends of the hinge tube are crimped to hold the hinge pin in place in the hinge tube.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENT

Figure 1:
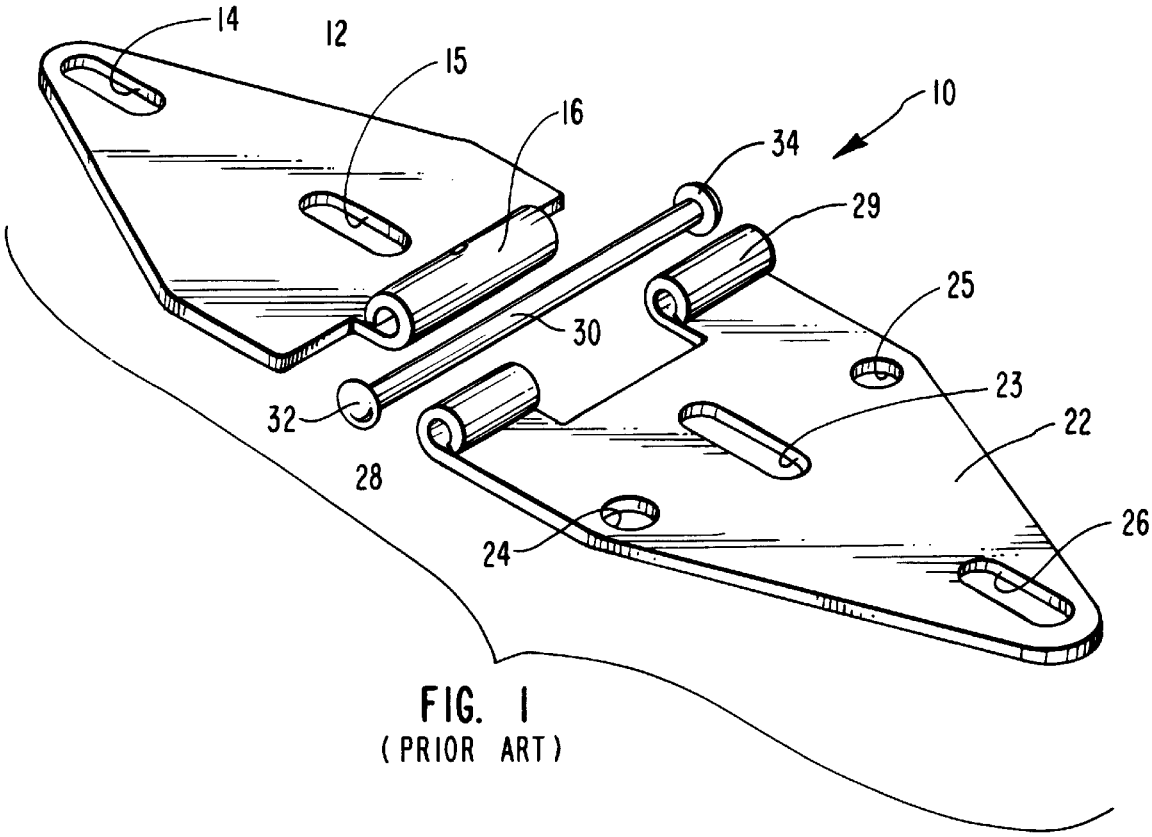
FIG. 1 (PRIOR ART)
FIG. 1 (PRIOR ART) is an exploded, perspective view of a prior art hinge showing the relatively large, conventional hinge pin.

The invention is best understood from the following description with reference to the drawing wherein like parts are designated by like numerals throughout and taken in conjunction with the appended claims.

Discussion of the Prior Art

Referring now to FIGS. 1 (PRIOR ART) and 2 (PRIOR ART), a conventional prior art hinge is shown generally at 10 and includes an upper leaf 12 and a lower leaf 22. A hinge pin 30 joins upper leaf 12 to lower leaf 22 in a pivotal relationship. Upper leaf 12 includes two vertically aligned mounting slots 14 and 15 and a centrally located or center pin tube 16. Correspondingly, lower leaf 22 includes a mounting slot 23 and three mounting holes 24–26. A pair of spaced pin tubes 28 and 29 are formed in lower leaf 22 and are designed to bracket center pin tube 16 to form a continuous pin tube for hinge pin 30.

Hinge pin 30 is a conventional hinge pin and is shown herein as being fabricated from a 3/16 inch (0.476 cm) steel rod having a left head 32 and a right head 34 formed on each end of hinge pin 30. Clearly, of course, left head 32 and right head 34 are formed on the respective ends of hinge 10 during manufacture of prior art hinge 10. Specifically, upper leaf 12 and lower leaf 22 are each stamped from a suitable metal stock which in this instance is a 14 gauge plate steel. Thereafter, center pin tube 16 is formed in upper leaf 12 while spaced pin tubes 28 and 29 are formed in lower leaf 22. Spaced pin tubes 28 and 29 are then brought into bracketing alignment with center pin tube 16 and hinge pin 30 is inserted therethrough. Left head 32 and right head 34 are then deformably created in the respective ends of hinge pin 30 to securely engage hinge pin 30 into center pin tube 16 and spaced pin tubes 28 and 29 thereby interlocking upper leaf 12 to lower leaf 22 in a pivotal arrangement about hinge pin 30.

Figure 2:
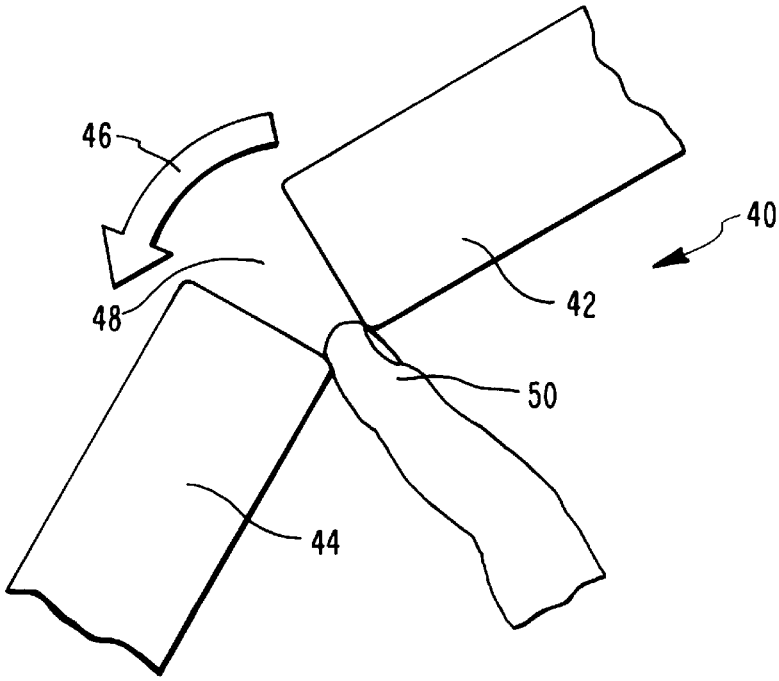
FIG. 2 (PRIOR ART)
FIG. 2 (PRIOR ART) is a schematic, cross-sectional view of a fragmentary portion of two door sections hingedly joined by the prior art hinge of FIG. 1 (PRIOR ART) and shown in the environment of the tip of a finger inserted between the door sections.

Referring now specifically to FIG. 2 (PRIOR ART) a sectional door is shown generally at 40 and includes an upper door section 42 and a lower door section 44. Sectional door 40 is shown during its transition from its elevated, open position to its lowered, closed position. The movement of sectional door is shown schematically by downward movement arrow 46. Upper door section 42 is pivotally joined to lower door section 44 by hinge 10 FIG. 1 (PRIOR ART) which is not shown herein for clarity in illustrating what happens as upper door section 42 is pivotally moved relative to lower door section 44 as sectional door 10 is lowered as shown by downward movement arrow 46. Specifically, a relatively wide gap 48 opens and then rapidly closes as upper door section 42 follows lower door section 44 in the downward travel of sectional door 40 from the horizontal, overhead, open position to the vertical, closed position. Gap 48 opens sufficiently to allow the tips of one or more fingers 50 to be inserted therein with tragic consequences. The crushing force generated as gap 48 closes has been calculated as being in excess of several hundred pounds per square inch, a force sufficient to extensively damage if not amputate the affected portion of fingers 50. Not only is this crushing force severe but the closure of gap 48 proceeds with significant speed so that even an intentional insertion of the tips of fingers 50 into gap 48 may still result in damage to the tips of fingers 50 due to slowed reflexes in pulling the tips of fingers 50 out of gap 48 as it closes.

Detailed Description

Figure 3:
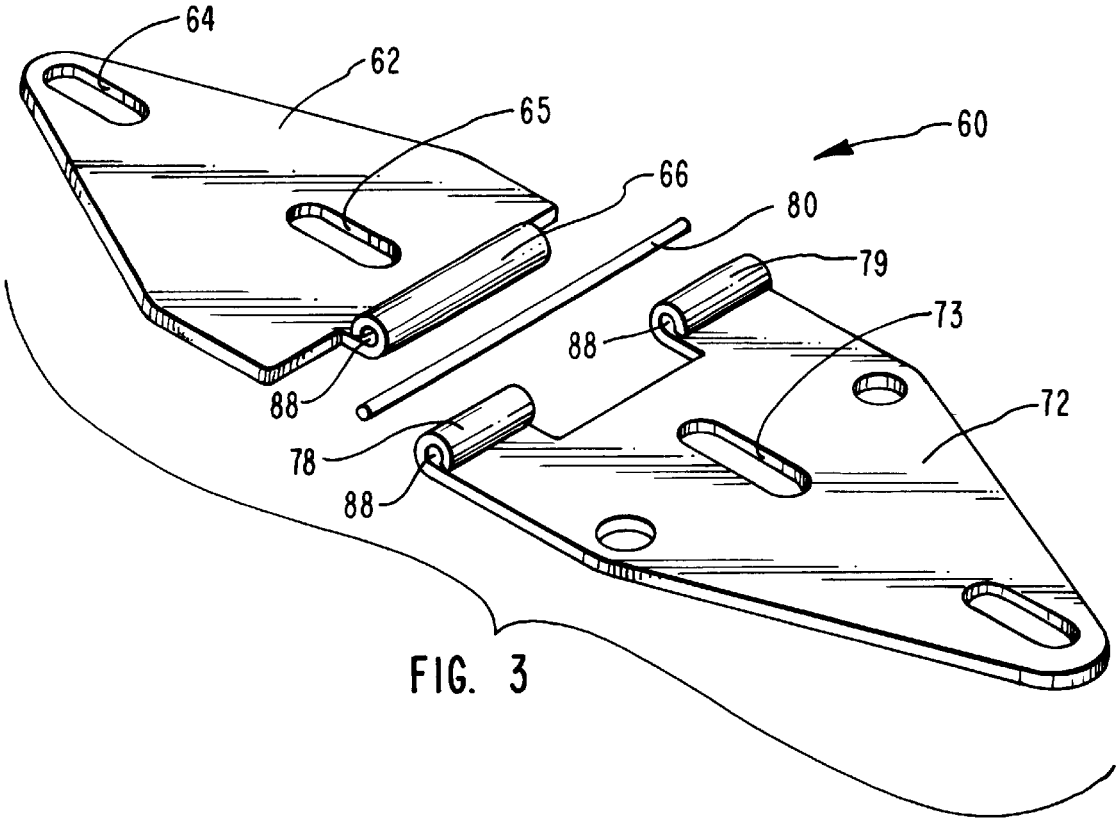
FIG. 3 is an exploded, perspective view of the novel hinge apparatus of this invention showing my unique, spring steel hinge pin.
Figure 5:
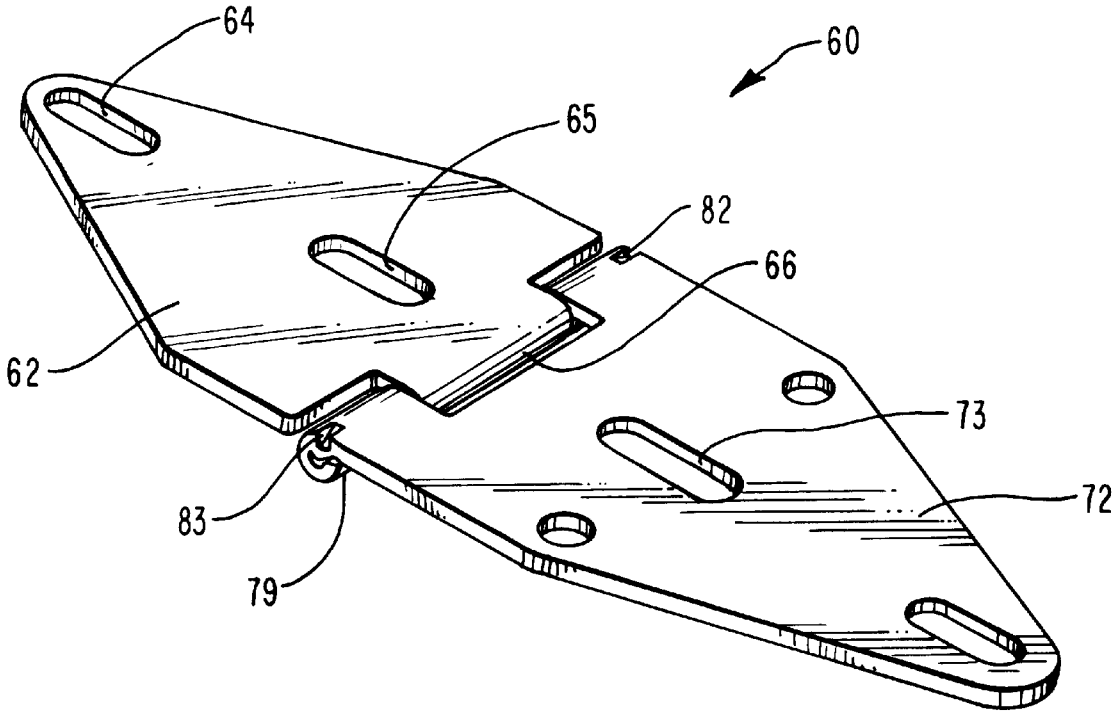
FIG. 5 is a perspective view of the bottom face of my novel hinge showing the unique retainment crimps to hold the spring steel hinge pin in place.

Referring now to FIGS. 3 and 5, the novel low-profile hinge apparatus of this invention is shown generally at 60 and includes an upper leaf 62 and a lower leaf 72 hingedly joined together by a spring steel hinge pin 80. Advantageously and surprisingly, the use of spring steel hinge pin 80 to pivotally join lower leaf 72 to upper leaf 62 provides low-profile hinge 60 with its novel low profile feature and consequently reduces the gap opening between door sections as will be discussed more fully hereinafter. Given the customary manufacturing practice for fabricating prior art 10 (FIG. 1 PRIOR ART) wherein the ends of prior art hinge pin 30 is deformably shaped to create left head 32 and right head 34, my invention is surprising and unexpected since spring steel is well known for the fact that it is impossible to deformably shape the ends of spring steel hinge pin 80 to create any type of retainer head. Accordingly, it would not have been obvious to one of ordinary skill in the art to substitute spring steel for hinge pin 30 of the prior art due to the impossibility of deformably shaping the spring steel to create left head 32 and right head 34. Further, the use of spring steel for spring steel hinge pin 80 provides low-profile hinge 10 with an equivalent or even greater strength than prior art hinge 10 shown in FIG. 1 (PRIOR ART). Low-profile hinge 60 is fabricated to be used as a replacement for prior art hinge 10 and, therefore, is dimensionally configured to be essentially identical to prior art hinge 10 with the exception of the surprisingly lower profile and correspondingly reduced pivotal profile as will be discussed further. Upper leaf 62 includes two, vertically aligned slots 64 and 65 and a diametrally reduced pin tube 66. Lower leaf 72 includes a slot 73 and three holes 74–76 therein for purposes of mounting lower leaf 72. Lower leaf 72 also includes a pair of diametrally reduced pin tubes 78 and 79 which are configured to bracket pin tube 66 to receive therethrough spring steel hinge pin 80.

Spring steel hinge pin 80, as the name implies, is fabricated from spring steel since spring steel is the only suitable material having the necessary strength characteristics for low-profile hinge 60. In particular, the diameter of spring steel hinge pin 80 is only ⅛ inch (0.318) in diameter and, therefore, is significantly smaller than hinge pin 30 FIG. 1 (PRIOR ART) so that if ordinary steel were used for the fabrication of a hinge pin having a diameter identical to that of spring steel hinge pin 80, the hinge so fabricated would fail under ordinary forces. However, by fabricating my novel, low-profile hinge 60 using spring steel hinge pin 80, I am able to provide low-profile hinge 60 with a surprisingly low profile.

The fabrication of spring steel hinge pin 80 from spring steel means that one can not deformably shape the ends thereof into retainer heads similar to left head 32 and right head 34 of prior art hinge 10, FIG. 1 (PRIOR ART), for the purpose of retaining spring steel hinge pin 80 in pin tubes 78, 66, and 79. Instead, I have found it necessary to foreshorten the length of spring steel hinge pin 80 so that it is incrementally shorter than the total length of pin tube 78, 66, and 79. Spring steel hinge pin 80 is then placed inside pin tube 78, 66, and 79 and the outer ends of pin tubes 78 and 79 are crimped to form detents 82 and 83, FIG. 5, in the respective ends thereof.

Figure 4:
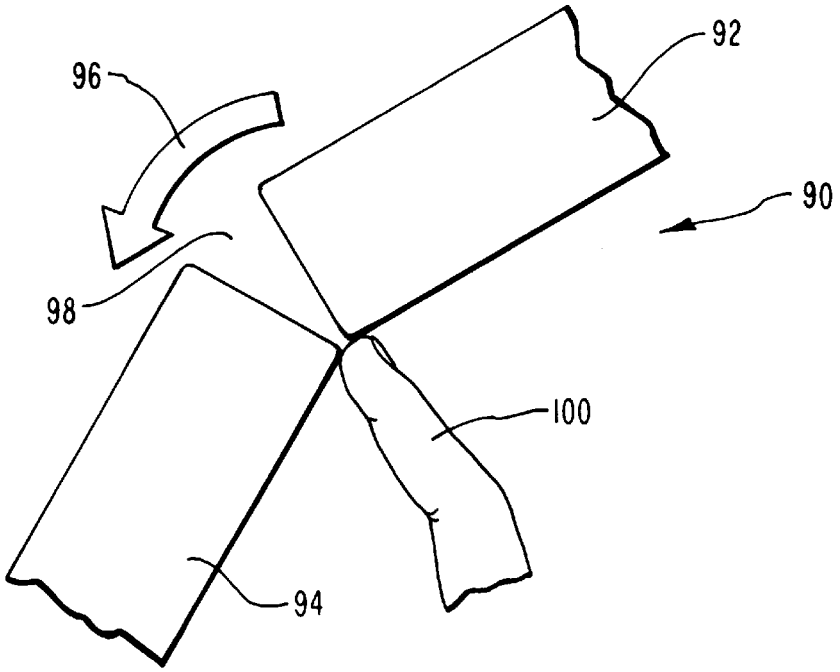
FIG. 4 is a schematic, cross-sectional view of a fragmentary portion of two door sections hingedly joined by my novel hinge of FIG. 3 and shown in the environment of a tip of a finger which cannot be inserted between the door sections.

Referring now to FIG. 4, a fragmentary portion of a sectional door is shown generally at 90 and includes an upper door section 92 hingedly mounted to a lower door section 94, by my novel, low-profile hinge 60, FIGS. 3 and 5, which is not shown herein for ease of illustration. Sectional door 90 is identical to sectional door 40, FIG. 2 (PRIOR ART), with the exception that upper door section 92 is hingedly joined to lower door section 94 by low profile hinge 60, FIGS. 3 and 5. Advantageously, the presence of low-profile hinge 60 significantly reduces the opening of a gap 98 thereby precluding the tip of a finger 100 from being inserted therein. Specifically, as sectional door 90 is in transit between the upper, open position and the lower, closed position (as indicated schematically by the downward movement shown by arrow 96) upper door section 92 pivots relative to lower door section 94 due to the pivot action supplied by low-profile hinge 60. This pivot action creates gap 98 between upper door section 92 and lower door section 94. Advantageously, low-profile hinge 60 and, more particularly, the presence of spring steel hinge pin 60 in low-profile hinge 60, reduces the width of gap 98 such that it will not allow the tip of finger 100 to be inserted therein. Accordingly, my novel invention of using an unexpected material, namely, a spring steel, for the fabrication of spring steel hinge pin 80 results in a surprisingly low profile for low-profile hinge 60 and a correspondingly reduced gap 98 between upper door section 92 and lower door section 94. This unexpected result is possible only due to the presence of spring steel hinge pin 80. Specifically the spring steel of spring steel hinge pin 80 allows me to significantly reduce the diameter of spring steel hinge pin 80 to a diameter significantly smaller than would otherwise be possible if I were to have used the steel of hinge pin 30 of prior art hinge 10, FIG. 1 (PRIOR ART). This is a surprising and unexpected result because of the nature of spring steel. Specifically, spring steel can not be deformably shaped to create the retainer heads of hinge pin 30, left head 32 and right head 34, FIG. 1 (PRIOR ART). This meant that I had to alter the manufacturing technique for my novel, low-profile hinge by (1) eliminating the deformation step for creating the pin heads, (2) foreshortening spring steel hinge pin 80, and (3) deformably creating detents 82 and 83 in the outer ends of pin tubes 78 and 79, respectively. Each of these steps run counter to the conventional practice of manufacturing hinges, particularly hinges for sectional doors, thereby clearly supporting the fact that my low-profile hinge 60 is a significant advancement in the art.

The Method

The method of this invention involves selecting a metal stock customarily used in the manufacture of prior art hinge 10, FIG. 1 (PRIOR ART) and stamping the same to produce upper leaf 62 and lower leaf 72 of low-profile hinge 60. In order to provide low-profile hinge 60 with the capability of being used as a retrofit for hinge 10, the overall dimensions of low-profile hinge 60 are identical to those of hinge 10. The only exception to the dimensions is that pin tube 88 is formed with a significantly reduced diameter to accommodate the insertion of spring steel hinge pin 80 therein.

Spring steel hinge pin 80 is cut from a spring steel stock having the preselected reduced diameter of only about ⅛ inch (0.318 cm). Importantly, spring steel hinge pin 80 is selectively cut to a length incrementally shorter than the length of pin tube 88. This means that spring steel hinge pin 80 will be recessed at each end inside pin tube 88 thereby leaving a space at each end of pin tube 88 which can be crimped to securely engage spring steel hinge pin 80 in place inside pin tube 88. These crimped ends of pin tube 88 are formed as detents 82 and 83 shown in FIG. 5.

Low-profile hinge 60 is mounted to sectional door 90 so as to pivotally engage upper door section 92 to lower door section 94. Advantageously, the presence of the reduced diameter of spring steel hinge pin 80 provides low-profile hinge 60 with the capability to reduce the width of gap 98 sufficiently to preclude the insertion of the tip of finger 100 into gap 98.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by united states letters patent is:

1. A low-profile hinge for a sectional door, said low-profile hinge providing for a significant reduction in the width of the gap between door sections comprising:

a first hinge leaf fabricated from a mild steel and having a first end and a second end, said first end of said first hinge leaf having a first diametrally reduced pin tube formed therein;

a second hinge leaf fabricated from said mild steel and having a first end and a second end, said first end of said second hinge leaf having a second diametrally reduced pin tube formed therein;

a diametrally reduced pin tube formed by aligning said first diametrally reduced pin tube with said second diametrally reduced pin tube, said diametrally reduced pin tube having a first end and a second end; and a spring steel hinge pin, said spring steel hinge pin having a diametrally reduced diameter not greater than one-eighth inch (0.318 cm), said spring steel hinge pin having a length that is incrementally shorter than said diametrally reduced pin tube and being telescopically received in said diametrally reduced pin tube.

2. The low-profile hinge defined in claim 1 wherein said first end of said diametrally reduced pin tube is crimped with a first detent and said second end of said diametrally reduced pin tube is crimped with a second detent, said first detent and said second detent forming a retaining means for retaining said spring steel hinge pin inside said diametrally reduced pin tube.

3. A low-profile hinge comprising:

a first hinge leaf fabricated from a mild steel and having a first hinge end formed as a first portion of a pin tube, said first portion of a pin tube having a diametrally reduced diameter;

a second hinge leaf fabricated from said mild steel and having a second hinge end formed as a second portion of a pin tube, said second portion of a pin tube having said diametrally reduced diameter;

a pin tube comprising said first portion of a pin tube in axial alignment with said second portion of a pin tube;

a spring steel hinge pin incrementally shorter than said pin tube and having an external diameter not greater than one-eighth inch (0.318 cm) to accommodate being telescopically inserted into said pin tube; and retainer means for retaining said spring steel hinge pin in said pin tube, said retainer means comprising a detent formed in each end of said pin tube said detent retaining said spring steel hinge pin in said pin tube.

4. A method for reducing the gap between hingedly joined adjacent door sections of a sectional door with a low-profile between door sections comprising the steps of:

preparing a low-profile hinge from standard metal stock with a diametrally reduced pin tube;

forming a spring steel hinge pin having a diametrally reduced diameter not greater than one-eighth inch (0.318 cm) and a length that is incrementally shorter than said pin tube;

inserting said diametrally reduced hinge pin in said diametrally reduced pin tube;

crimping each end of said pin tube thereby retaining said spring steel hinge pin in said pin tube; and reducing said gap between door sections by securing a plurality of said low-profile hinges to the sectional door to hingedly join adjacent door sections, said diametrically reduced spring steel hinge pin imparting low-profile characteristic features to said low-profile hinges thereby reducing said gaps between the door sections.

* * * * *